US008928569B2

(12) United States Patent
Kang

(10) Patent No.: US 8,928,569 B2
(45) Date of Patent: Jan. 6, 2015

(54) DRIVER OF PROMOTING PIXEL CHARGING ABILITY OF THIN FILM TRANSISTOR AND METHOD THEREOF

(75) Inventor: Chihtsung Kang, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 254 days.

(21) Appl. No.: 13/376,606

(22) PCT Filed: Aug. 12, 2011

(86) PCT No.: PCT/CN2011/078313

§ 371 (c)(1),
(2), (4) Date: Dec. 7, 2011

(87) PCT Pub. No.: WO2013/020300

PCT Pub. Date: Feb. 14, 2013

(65) Prior Publication Data

US 2013/0038235 A1 Feb. 14, 2013

(30) Foreign Application Priority Data

Aug. 5, 2011 (CN) ..... 2011 1 0224313

(51) Int. Cl.
*G09G 3/36* (2006.01)

(52) U.S. Cl.
CPC ..... *G09G 3/3648* (2013.01); *G09G 3/3614* (2013.01); *G09G 2300/0876* (2013.01)
USPC ..... 345/92

(58) Field of Classification Search
CPC ..... G09G 3/3614; G09G 3/3648
USPC ..... 345/92; 315/240; 349/42
See application file for complete search history.

(56) References Cited

U.S. PATENT DOCUMENTS

2002/0158860 A1* 10/2002 Yang ..... 345/209
2011/0309367 A1* 12/2011 Um et al. ..... 257/59

* cited by examiner

*Primary Examiner* — Kevin M Nguyen
*Assistant Examiner* — Kenneth B Lee, Jr.

(57) ABSTRACT

Disclosed is related with a LCD technology, and particularly to a driver of promoting pixel charging ability of a thin film transistor and a method thereof. The driver of promoting pixel charging ability of a thin film transistor comprises a thin film transistor, a first capacitor and a second capacitor. The source of the thin film transistor is coupled to the first capacitor and the second capacitor respectively. As the drain voltage switches from positive polarity to negative polarity or from negative polarity to positive polarity, a voltage different between a source voltage stored by the thin film transistor and the first capacitor voltage is higher than a predetermined value. The present invention is capable of promoting the charge current and the pixel charging ability. Meanwhile, the requirement of the metal line width can be diminished to improve aperture ratio and raise transmittance of product.

14 Claims, 3 Drawing Sheets

| sequence | A' | B' | C' | D' | E' |
|---|---|---|---|---|---|
| Vst | 5 | 5+V | 5+V | 5+V | 5 |
| Vcom | 5 | 5 | 5 | 5 | 5 |
| Vs | 10+V2 | 10+V2+V1 | 0 | 0 | -V2 |
| Vd | 0 | 0 | 0 | 0 | 0 |
| Vg | -5 | -5 | 23 | -5 | -5 |

FIG. 3

| sequence | A | B | C | D | E |
|---|---|---|---|---|---|
| Vst | 5 | 5-V | 5-V | 5-V | 5 |
| Vcom | 5 | 5 | 5 | 5 | 5 |
| Vs | -V2 | -V2-V1 | 10 | 10 | 10+V2 |
| Vd | 10 | 10 | 10 | 10 | 10 |
| Vg | -5 | -5 | 23 | -5 | -5 |

FIG. 4

DRIVER OF PROMOTING PIXEL CHARGING ABILITY OF THIN FILM TRANSISTOR AND METHOD THEREOF

BACKGROUND OF THE INVENTION

1. Field of the Invention

The present invention generally relates to a LCD technology field, and more particularly to a driver of promoting pixel charging ability of a thin film transistor and a method thereof.

2. Description of Prior Art

With the development of technology, the Liquid Crystal Display (LCD) has become the major product of displays nowadays. Thin film transistor-Liquid Crystal Display (TFT-LCD) is one of the active matrix liquid crystal display (AM-LCD). Generally, the metal-oxide-semiconductor field-effect transistor (MOS-FET) is employed as a charge element in the TFT-LCD panel. The running condition of the existing thin film transistors is: Vgh is 23V. The threshold voltage Vt is 1V. As considering a general data driving voltage 0V-14V, the largest charge and discharge voltage difference Vds is 14V (voltage difference between positive polarity voltage and negative polarity voltage). The voltage Vds□Vgs−Vt. Regarding the I-V Property of the thin film transistor, the thin film transistor is operated in the linear region. The current Id is relevant with the voltage difference of the polarity switching. Put differently, the current Id is in direct proportion to the voltage difference Vds (Id∞(Vgs−Vt)Vds) and the specific formula is introduced below:

$$I_{DS} \approx \mu_{eff} \zeta C_i^{\alpha-1} \frac{W}{L} (V_{GS} - V_T)^{\alpha-1} V_{DS}$$

However, the aforesaid charge method may increase the RC loading. Then, the signal distortion result in under charge.

For solving such issues, the product design in prior art requires the sacrifice of the aperture ratio (the higher the aperture ratio is, the brighter the whole screen becomes) to utilize wider metal line width to reduce the RC (current-limiting resistor) loading or manufacturing TFT element with 4PEP (Photo Etching Process, using the photoresist) to promote the phenomenon of under charge. However, such design results in over low aperture ratio and influence the brightness of the whole screen. The transmittance of the product and the processes are also tremendously influenced.

Consequently, there is a need to develop a driver of promoting pixel charging ability of a thin film transistor and a method thereof to solve the drawbacks of prior art.

SUMMARY OF THE INVENTION

An objective of the present invention is to provide a driver of promoting pixel charging ability of a thin film transistor and a method thereof to solve the problem of under charge of existing thin film transistors and to solve the problems of the transmittance of the product and the processes influenced by the thin film transistor product design.

The present invention is realized by a driver of promoting pixel charging ability of a thin film transistor, characterized in comprising a thin film transistor, a first capacitor and a second capacitor, and a source of the thin film transistor is coupled to the first capacitor and the second capacitor respectively, and a drain of the thin film transistor is coupled to a drain voltage, and a gate of the thin film transistor is coupled to a gate voltage, and the other end of the first capacitor is coupled to a first capacitor voltage, and the other end of the second capacitor is coupled to a second capacitor voltage, and as the drain voltage switches from positive polarity to negative polarity, the second capacitor voltage is higher than a reference voltage and the thin film transistor is conducted, and then a voltage difference between the drain voltage and a source voltage of the thin film transistor is higher than an equivalent voltage, as the drain voltage switches from negative polarity to positive polarity, the second capacitor voltage is lower than the reference voltage and the thin film transistor is conducted, and then a voltage difference between the drain voltage and a source voltage of the thin film transistor is higher than the equivalent voltage, wherein the a voltage different between a source voltage stored by the thin film transistor and the first capacitor voltage is higher than a predetermined value.

In one preferable embodiment of the present invention, a positive polarity voltage is 10V and a negative polarity voltage is 0V, and the predetermined value of the voltage different between the source voltage stored by the thin film transistor and the first capacitor voltage is 5V.

In one preferable embodiment of the present invention, the reference voltage is 5V and the equivalent voltage is 10V.

The present invention also provides a driver of promoting pixel charging ability of a thin film transistor, characterized in comprising a thin film transistor, a first capacitor and a second capacitor, and a source of the thin film transistor is coupled to the first capacitor and the second capacitor respectively, and a drain of the thin film transistor is coupled to a drain voltage, and a gate of the thin film transistor is coupled to a gate voltage, and the other end of the first capacitor is coupled to a first capacitor voltage, and the other end of the second capacitor is coupled to a second capacitor voltage, and as a voltage of the drain voltage switches from positive polarity to negative polarity or from negative polarity to positive polarity, a voltage different between a source voltage stored by the thin film transistor and a first capacitor voltage is higher than a predetermined value.

In one preferable embodiment of the present invention, as the drain voltage switches from positive polarity to negative polarity, a voltage of the second capacitor voltage is higher than a reference voltage, wherein the reference voltage is 5V.

In one preferable embodiment of the present invention, as the thin film transistor is conducted, a voltage difference affecting charge to the pixel is higher than the equivalent voltage, wherein the equivalent voltage is 10V, and after discharge, the thin film transistor is cut off and the voltage of the second capacitor voltage is reinstated as the reference voltage, and the source voltage is lower than 0V.

In one preferable embodiment of the present invention, as the drain voltage switches from negative polarity to positive polarity, the second capacitor voltage is lower than a reference voltage, wherein the reference voltage is 5V.

In one preferable embodiment of the present invention, the thin film transistor is conducted, and a voltage difference between the drain voltage and the source voltage of the thin film transistor is higher than an equivalent voltage, wherein the equivalent voltage is 10V.

In one preferable embodiment of the present invention, after discharge, the thin film transistor is cut off and the voltage of the second capacitor voltage is reinstated as the reference voltage, and the source voltage is higher than 10V.

In one preferable embodiment of the present invention, a positive polarity voltage is 10V and a negative polarity voltage is 0V, and the predetermined value of the voltage different between the source voltage stored by the thin film transistor and the first capacitor voltage is 5V.

The present invention also provides a method of promoting pixel charging ability of a thin film transistor, comprising:

providing a voltage signal higher than a reference voltage as being a second capacitor voltage as a drain voltage switches from positive polarity to negative polarity;

providing a voltage signal lower than a reference voltage as being a second capacitor voltage as the drain voltage switches from negative polarity to positive polarity;

wherein a source of the thin film transistor is coupled to a first capacitor and a second capacitor respectively, and the other end of the first capacitor is coupled to a first capacitor voltage, and the other end of the second capacitor is coupled to the second capacitor voltage.

In one preferable embodiment of the present invention, as the drain voltage switches from positive polarity to negative polarity, the thin film transistor is not conducted and a source voltage is higher than an equivalent voltage, and the thin film transistor is conducted as a voltage difference between the drain voltage and the source voltage of the thin film transistor is higher than the equivalent voltage, and as the thin film transistor is cut off, the second capacitor voltage is reinstated as the reference voltage and the source voltage is lower than 0V, wherein the equivalent voltage is 10V.

In one preferable embodiment of the present invention, as the voltage of the drain voltage switches from negative polarity to positive polarity, the thin film transistor is not conducted and the source voltage is lower than 0V, and as the thin film transistor is conducted, a voltage difference between the drain voltage and the source voltage of the thin film transistor is higher than the equivalent voltage, and as the thin film transistor is cut off, the second capacitor voltage is reinstated as the reference voltage and the source voltage is higher than the equivalent voltage, wherein the equivalent voltage is 10V.

Comparing with the pixel charging elements of a thing film transistor of prior art, the skill of the present invention is able to raise the voltage Vds as charging to promote the charge current and the pixel charging ability, and furthermore to promote the phenomenon of under charge due to the signal distortion came from the RC loading (current limiting resistor loading); Meanwhile, the requirement of the metal line width can be diminished to improve aperture ratio and raise transmittance of product. With the present invention, the products which demands high voltage to activate the panel for improving the transmittance thereof can merely employ a driver IC of low voltage process to realize an objective of high voltage output.

For a better understanding of the aforementioned content of the present invention, preferable embodiments are illustrated in accordance with the attached figures for further explanation:

BRIEF DESCRIPTION OF THE DRAWINGS

FIG. 3 shows a data compare table of source voltages of a pixel of a thin film transistor switched from positive polarity to negative polarity according to the present invention;

FIG. 4 shows a data compare table of source voltages of a pixel of a thin film transistor switched from negative polarity to positive polarity according to the present invention;

DETAILED DESCRIPTION OF THE INVENTION

The following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

Figure 1:
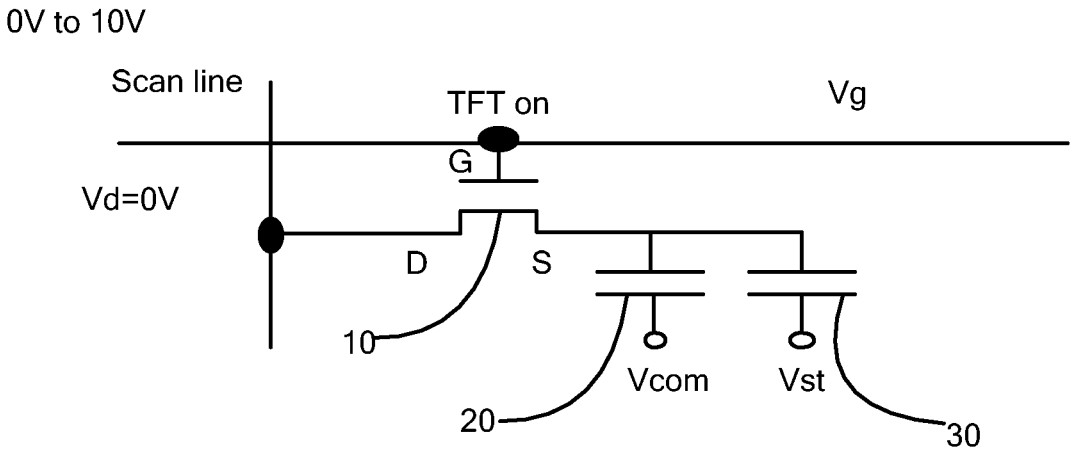
FIG. 1 shows a structure diagram of a preferable embodiment of a driver of promoting pixel charging ability of a thin film transistor according to the present invention.

Please refer to FIG. 1, which shows a structure diagram of a preferable embodiment of a driver of promoting pixel charging ability of a thin film transistor according to the present invention. As shown in FIG. 1, the driver comprises a thin film transistor 10, a first capacitor 20 and a second capacitor 30. The source of the thin film transistor 10 is coupled to one end of the first capacitor 20 and one end of the second capacitor 30. The drain of the thin film transistor 10 is coupled to a drain voltage Vd. The gate of the thin film transistor 10 is coupled to a gate voltage Vg. The other end of the first capacitor 20 is coupled to a first capacitor voltage Vcom. The other end of the second capacitor 30 is coupled to a second capacitor voltage Vst.

Figure 2:
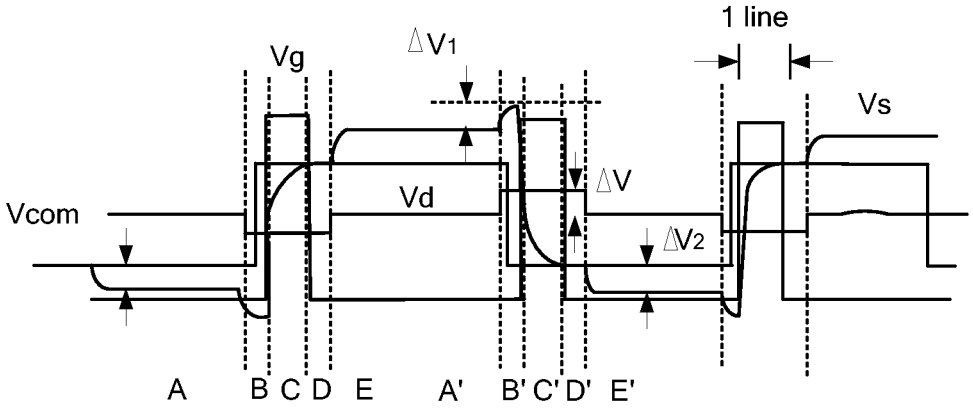
FIG. 2 shows an operating principle diagram of a driver of promoting pixel charging ability of a thin film transistor according to the present invention.

Please refer to FIG. 1 and FIG. 2. FIG. 2 shows an operating principle diagram of a driver of promoting pixel charging ability of a thin film transistor according to the present invention. As the drain voltage Vd switches from positive polarity to negative polarity, an equivalent voltage between the drain voltage and the source voltage Vds is 10V. In the preferable embodiment of the present invention, the positive polarity voltage is 10V and the negative polarity voltage is 0V. First, as the thin film transistor 10 is not conducted, the array corn provides a voltage signal higher than a reference voltage as being a second capacitor voltage for the second capacitor 30. In the preferable embodiment of the present invention, the symbol of the reference voltage is Vst and the voltage Vst is 5V. The foregoing voltage signal higher than the reference voltage is Vst+ΔV (higher than Vst with a value ΔV). The charge redistribution leads to that the voltage Vs is higher than the original voltage 10V with a value ΔV1+ΔV2 and becomes 10V+ΔV1+ΔV2; Then, the thin film transistor 10 is conducted, a voltage difference affecting charge to the pixel is: the voltage difference Vds between the drain voltage Vd and the source voltage Vs and Vds=−10−ΔV1−ΔV2, which is higher than the original voltage 10V. Correspondingly, a discharge current (Id∞(Vgs−Vt)Vds) becomes higher and the discharge period is shortened. After discharge, the final voltage of pixel is 0V and the thin film transistor is cut off. The second capacitor voltage applied to the second capacitor 30 is reinstated as the original reference voltage (i.e. from Vst+ΔV to Vst). The charge redistribution leads to that the voltage Vs becomes lower than the original voltage 0V with a value ΔV2 (a negative voltage). Ultimately, a voltage difference between the stored source voltage Vs of the whole liquid crystal and the voltage Vcom applied to the first capacitor 20 is higher than a predetermined value. The predetermined value is a voltage different between the source voltage stored by the thin film transistor and the first capacitor voltage. In the preferable embodiment of the present invention, the predetermined value is 5V. Therefore, the storage voltage of the liquid crystal can be promoted, even without a print circuit board supplying external lower data voltage (lower than 0V).

Please refer to FIG. 1, FIG. 2 and FIG. 3. FIG. 3 shows a data compare table of source voltages of a pixel of a thin film transistor switched from positive polarity to negative polarity according to the present invention. In FIG. 3, Before the thin film transistor 10 is conducted at C' stage, the voltage Vs is 10+V1+V2. When the thin film transistor 10 is just conducted at C' stage, the voltage Vg=23V and Vds=Vd−Vs=−10−ΔV1−ΔV2, which is higher than a default driving signal (Vds=10V) of a general thin film transistor to promote the charge current of the element.

In a similar way, as the drain voltage Vd switches from negative polarity 0V to positive polarity 10V, the equivalent voltage Vds is 0V. First, as the thin film transistor 10 is not conducted, the array corn provides a voltage signal higher than a reference voltage as being a second capacitor voltage for the second capacitor 30. In the preferable embodiment of the present invention, the symbol of the reference voltage is Vst. The foregoing voltage signal lower than the reference voltage is Vst−ΔV (lower than Vst with a value ΔV). The charge redistribution leads to that the voltage Vs is lower than the original voltage 0V with a value ΔV1+ΔV2 and becomes −ΔV1−ΔV2; At this moment, the thin film transistor 10 is conducted, a voltage difference affecting charge to the pixel is: the voltage difference Vds=−10+ΔV1+ΔV2, which is higher than the original voltage 10V and the discharge current becomes higher. After discharge, the final voltage of pixel is 0V and the thin film transistor is cut off. The second capacitor voltage applied to the second capacitor 30 is reinstated as the original reference voltage (from Vst−ΔV to Vst). The charge redistribution leads to that the voltage Vs becomes higher than the original voltage 10V with a value ΔV2. Ultimately, a voltage difference between the stored source voltage Vs of the whole liquid crystal and the voltage Vcom applied to the first capacitor 20 is higher than the normal voltage 5V. Put differently, the storage voltage of the liquid crystal can be promoted, even without a print circuit board supplying external higher data voltage (higher than 10V). Please refer to FIG. 1, FIG. 2 and FIG. 4 shows a data compare table of source voltages of a pixel of a thin film transistor switched from negative polarity to positive polarity according to the present invention. In FIG. 4, Before the thin film transistor 10 is conducted at C stage, the voltage Vs is −V1−V2. When the thin film transistor 10 is just conducted at C stage; the voltage Vg=23V and Vds=Vd−Vs=10+V1+V2, which is higher than a default driving signal (Vds=10V) of a general thin film transistor to promote the charge current of the element.

Figure 5:
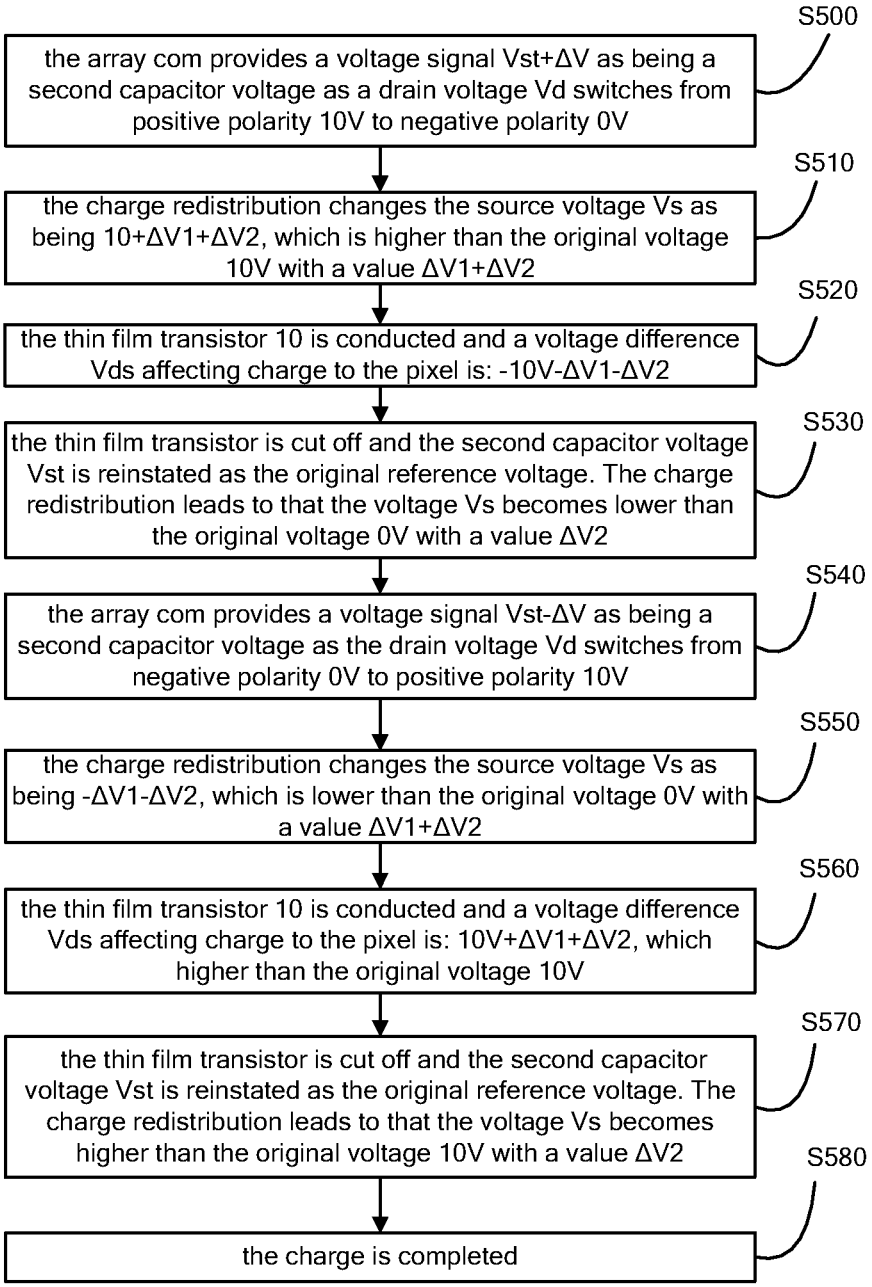
FIG. 5 shows a flow chart of a preferable embodiment of a method of promoting pixel charging ability of a thin film transistor according to the present invention.

Please refer to FIG. 5 shows a flow chart of a preferable embodiment of a method of promoting pixel charging ability of a thin film transistor according to the present invention. The method of promoting pixel charging ability of a thin film transistor according to the present invention comprises steps of:

Step 500: the array corn provides a voltage signal Vst+ΔV, which is higher than a reference voltage Vst as being a second capacitor voltage as a drain voltage Vd switches from positive polarity to negative polarity;

In this step, the positive polarity voltage is 10V and the negative polarity voltage is 0V. The equivalent voltage between the drain voltage and the source voltage (Vds) is 10V; wherein the drain of the thin film transistor is coupled to a first capacitor and a second capacitor respectively. The first capacitor and the second capacitor are parallel coupled.

Step 510: the charge redistribution changes the source voltage Vs as being 10+ΔV1+ΔV2, which is higher than the original voltage 10V with a value ΔV1+ΔV2;

Step 520: the thin film transistor 10 is conducted and a voltage difference Vds affecting charge to the pixel is: 10V+ΔV1+ΔV2;

In this step, the voltage difference affecting charge to the pixel is higher than 10V. Correspondingly, a discharge current (Id∞(Vgs−Vt)Vds) becomes higher and the discharge period is shortened. After discharge, the final voltage of pixel is 0V.

Step 530: the thin film transistor is cut off and the second capacitor voltage Vst applied to the second capacitor 30 is reinstated as the original reference voltage (i.e. from Vst+ΔV to Vst). The charge redistribution leads to that the voltage Vs becomes lower than the original voltage 0V with a value ΔV2;

In this step, the source voltage becomes a negative voltage. Ultimately, a voltage difference between the stored source voltage Vs of the whole liquid crystal and the voltage Vcom applied to the first capacitor is higher than a normal voltage 5V. The storage voltage of the liquid crystal can be promoted, even without a print circuit board supplying external lower data voltage (lower than 0V).

Step 540: the array com provides a voltage signal Vst−ΔV lower than a reference voltage Vst as being a second capacitor voltage as the drain voltage Vd switches from negative polarity to positive polarity;

The positive polarity voltage is 10V and the negative polarity voltage is 0V. The drain voltage Vd switches from negative polarity 0V to positive polarity 10V. The equivalent voltage Vds between the drain voltage and the source voltage is 10V.

Step 550: the charge redistribution changes the source voltage Vs as being −ΔV1−ΔV2, which is lower than the original voltage 0V with a value ΔV1+ΔV2;

Step 560: the thin film transistor 10 is conducted and a voltage difference Vds affecting charge to the pixel is: 10V+ΔV1+ΔV2, which higher than the original voltage 10V;

In this step, a discharge current (Id∞(Vgs−Vt)Vds) becomes higher, correspondingly and the final voltage of pixel is 10V after discharge.

Step 570: the thin film transistor is cut off and the second capacitor voltage Vst is reinstated as the original reference voltage (i.e. from Vst−ΔV to Vst). The charge redistribution leads to that the voltage Vs becomes higher than the original voltage 10V with a value ΔV2;

In this step, a voltage difference between the stored source voltage Vs of the whole liquid crystal and the voltage Vcom applied to the first capacitor is higher than a normal voltage 5V. In other word, the storage voltage of the liquid crystal can be promoted, even without a print circuit board supplying external lower data voltage (lower than 0V).

Step 580: the charge is completed.

The driver of promoting pixel charging ability of a thin film transistor and the method thereof provided by the present invention is capable of raising the voltage Vds as charging to promote the charge current and the pixel charging ability, and furthermore to promote the phenomenon of under charge due to the signal distortion came from the RC loading RC loading (current limiting resistor loading); Meanwhile, the requirement of the metal line width can be diminished to improve aperture ratio and raise transmittance of product. With the present invention, the products which demands high voltage to activate the panel for improving the transmittance thereof can merely employ a driver IC of low voltage process to realize an objective of high voltage output. The present invention is applicable to a display comprising a horizontal array com in accordance with row driving, a display comprising a vertical array com in accordance with vertical com and column driving.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A driver of promoting pixel charging ability of a thin film transistor, characterized in comprising a thin film transistor, a first capacitor and a second capacitor, and a source of the thin film transistor is coupled to the first capacitor and the second capacitor respectively, and a drain of the thin film transistor is coupled to a drain voltage, and a gate of the thin film transistor is coupled to a gate voltage, and the other end of the first capacitor is coupled to a first capacitor voltage, and the other end of the second capacitor is coupled to a second capacitor voltage, and as the drain voltage switches from positive polarity to negative polarity, the second capacitor voltage is higher than a reference voltage and the thin film transistor is conducted, and then a voltage difference between the drain voltage and a source voltage of the thin film transistor is higher than an equivalent voltage, as the drain voltage switches from negative polarity to positive polarity, the second capacitor voltage is lower than the reference voltage and the thin film transistor is conducted, and then a voltage difference between the drain voltage and a source voltage of the thin film transistor is higher than the equivalent voltage, wherein the a voltage different between a source voltage stored by the thin film transistor and the first capacitor voltage is higher than a predetermined value.

2. The driver of promoting pixel charging ability of the thin film transistor of claim 1, characterized in that a positive polarity voltage is 10V and a negative polarity voltage is 0V, and the predetermined value of the voltage different between the source voltage stored by the thin film transistor and the first capacitor voltage is 5V.

3. The driver of promoting pixel charging ability of the thin film transistor in any one of claims 1 and 2, characterized in that the reference voltage is 5V and the equivalent voltage is 10V.

4. A driver of promoting pixel charging ability of a thin film transistor, characterized in comprising a thin film transistor, a first capacitor and a second capacitor, and a source of the thin film transistor is coupled to the first capacitor and the second capacitor respectively, and a drain of the thin film transistor is coupled to a drain voltage, and a gate of the thin film transistor is coupled to a gate voltage, and the other end of the first capacitor is coupled to a first capacitor voltage, and the other end of the second capacitor is coupled to a second capacitor voltage, and as the drain voltage switches from positive polarity to negative polarity or from negative polarity to positive polarity, a voltage different between a source voltage stored by the thin film transistor and a first capacitor voltage is higher than a predetermined value, and as the drain voltage switches from positive polarity to negative polarity, the second capacitor voltage is higher than a reference voltage, and as the drain voltage switches from negative polarity to positive polarity, the second capacitor voltage is lower than the reference voltage.

5. The driver of promoting pixel charging ability of the thin film transistor of claim 4, characterized in that as the drain voltage switches from positive polarity to negative polarity, a voltage of the second capacitor voltage is higher than a reference voltage, wherein the reference voltage is 5V.

6. The driver of promoting pixel charging ability of the thin film transistor of claim 5, characterized in that as the thin film transistor is conducted, a voltage difference affecting charge to the pixel is higher than the equivalent voltage, wherein the equivalent voltage is 10V, and after discharge, the thin film transistor is cut off and the voltage of the second capacitor voltage is reinstated as the reference voltage, and the source voltage is lower than 0V.

7. The driver of promoting pixel charging ability of the thin film transistor of claim 4, characterized in that as the drain voltage switches from negative polarity to positive polarity, the second capacitor voltage is lower than a reference voltage, wherein the reference voltage is 5V.

8. The driver of promoting pixel charging ability of the thin film transistor of claim 7, characterized in that the thin film transistor is conducted, and a voltage difference between the drain voltage and the source voltage of the thin film transistor is higher than an equivalent voltage, wherein the equivalent voltage is 10V.

9. The driver of promoting pixel charging ability of the thin film transistor of claim 8, characterized in that after discharge, the thin film transistor is cut off and the voltage of the second capacitor voltage is reinstated as the reference voltage, and the source voltage is higher than 10V.

10. The driver of promoting pixel charging ability of the thin film transistor of claim 4, characterized in that a positive polarity voltage is 10V and a negative polarity voltage is 0V, and the predetermined value of the voltage different between the source voltage stored by the thin film transistor and the first capacitor voltage is 5V.

11. A method of promoting pixel charging ability of a thin film transistor, characterized in comprising:

providing a voltage signal higher than a reference voltage as being a second capacitor voltage as a drain voltage switches from positive polarity to negative polarity;

providing a voltage signal lower than a reference voltage as being a second capacitor voltage as the drain voltage switches from negative polarity to positive polarity;

wherein a source of the thin film transistor is coupled to a first capacitor and a second capacitor respectively, and the other end of the first capacitor is coupled to a first capacitor voltage, and the other end of the second capacitor is coupled to the second capacitor voltage.

12. The method of promoting pixel charging ability of the thin film transistor of claim 11, characterized in that as the drain voltage switches from positive polarity to negative polarity, the thin film transistor is not conducted and a source voltage is higher than an equivalent voltage, and the thin film transistor is conducted as a voltage difference between the drain voltage and the source voltage of the thin film transistor is higher than the equivalent voltage, and as the thin film transistor is cut off, the second capacitor voltage is reinstated as the reference voltage and the source voltage is lower than 0V, wherein the equivalent voltage is 10V.

13. The method of promoting pixel charging ability of the thin film transistor of claim 12, characterized in that as the voltage of the drain voltage switches from negative polarity to positive polarity, the thin film transistor is not conducted and the source voltage is lower than 0V, and as the thin film transistor is conducted, a voltage difference between the drain voltage and the source voltage of the thin film transistor is higher than the equivalent voltage, and as the thin film transistor is cut off, the second capacitor voltage is reinstated as the reference voltage and the source voltage is higher than the equivalent voltage, wherein the equivalent voltage is 10V.

14. The method of promoting pixel charging ability of the thin film transistor in claim 2, characterized in that the reference voltage is 5V and the equivalent voltage is 10V.

* * * * *